US006709473B2

(12) United States Patent
Cheney et al.

(10) Patent No.: US 6,709,473 B2
(45) Date of Patent: Mar. 23, 2004

(54) POURABLE GAS FIREPLACE CRACKLING COMPOSITION

(76) Inventors: Alan A. Cheney, 101 Lost Lake Ct., Folsom, CA (US) 95630; Maureen Cheney, 101 Lost Lake Ct., Folsom, CA (US) 95630

( * ) Notice: Subject to any disclaimer, the term of this patent is extended or adjusted under 35 U.S.C. 154(b) by 119 days.

(21) Appl. No.: 10/120,085

(22) Filed: Apr. 9, 2002

(65) Prior Publication Data

US 2003/0189185 A1 Oct. 9, 2003

(51) Int. Cl.[7] ..... C10L 5/00
(52) U.S. Cl. ..... 44/628; 44/901
(58) Field of Search ..... 44/603, 628, 901, 44/600, 540; 126/263.01

(56) References Cited

U.S. PATENT DOCUMENTS 3,338,691 A * 8/1967 Knowles et al. ..... 44/275
4,169,709 A 10/1979 Stima
4,818,249 A 4/1989 Barrett
4,828,485 A 5/1989 Jankowski
5,118,539 A 6/1992 Sebby et al.
5,393,310 A 2/1995 Wollen
5,524,609 A 6/1996 Krull
5,868,804 A 2/1999 Williams
6,017,373 A 1/2000 Frisch
6,245,119 B1 6/2001 Chandaria
6,314,191 B1 * 11/2001 Smith ..... 381/160
2002/0014036 A1 2/2002 Chandaria

* cited by examiner

*Primary Examiner*—Cephia D. Toomer
(74) *Attorney, Agent, or Firm*—John P. Costello

(57) ABSTRACT

A pourable composition for use in gas fireplaces that, when heated to an effective temperature, produces an audible crackling sound and emits the scents of a wood fire. This composition is intended to introduce the pleasant sounds and scents of the wood fire experience to a gas fireplace. The composition is comprised of various edible items, such as seeds and non-edible items such as pumice, volcanic ash, and calcareous sand. A liquid oil component acts as a binder. When placed in a ceramic receptacle, and heated, a tablespoon amount of the composition produces audible crackling sounds for between 30–120 minutes.

16 Claims, No Drawings

POURABLE GAS FIREPLACE CRACKLING COMPOSITION

FIELD OF INVENTION

The invention relates to a composition that when placed inside a ceramic receptacle within a vented-gas fireplace, produces crackling and popping sounds and a noticeable scent indistinguishable from the crackling and popping sounds and scents of a natural wood log burning in a conventional fireplace.

BACKGROUND OF INVENTION

Most homes are built with a fireplace either to provide warmth or to provide visual, audible, or sensory enjoyment. Natural wood, burning in these fireplaces fulfills all of these needs. Unfortunately, in our current modern world, wood has a number of increasingly evident drawbacks. These are: the overall limited supply of wood and the required destruction of trees in order to supply this wood; the effort required to handle the wood, from chopping, transportation, stacking, placing in the fire, and clean up of residual ashes; and the pollution created from burning wood. These problems have led to the use of alternative methods of creating fire in a fireplace.

The two primary available alternatives to wood fires are: 1) use of an artificial log (comprised of one or more flammable materials, typically cellulosic materials, and a wax binder blended in the shape of natural log) in a conventional fireplace, such as a Duraflame® log or other commercially available similar product or 2) use of vented-gas fireplaces with ceramic logs, burning natural gas. Both alternatives have suffered from "realism" drawbacks. Over the years improvements have been made in the "realism" of the flame, "realism" of the ceramic logs, and "realism" of the sound and scent of artificial logs.

The prior art has dealt with producing an audible sound in an artificial log. These logs, however, cannot be used in a vented-gas fireplace. U.S. Pat. No. 5,868,804, issued Feb. 9, 1999 to Williams et.al., is directed to an artificial log having an additive consisting of: 1) mustard, flax, cumin, or sesame seed or a combination thereof 2) hollow synthetic spheres, or 3) a combination of the seed component and the hollow synthetic spheres in order to provide an audible crackling sound during the burning of the log. U.S. Pat. No. 6,017,373, issued Jan. 25, 2000 to Frisch, is directed to an artificial log incorporating coriander seed along with other naturally occurring geologic material of volcanic origin. A typical composition in Frisch contains 4–6% by weight coriander seed to improve the audible crackling sound of an artificial log.

Prior art compositions have been directed at improving the "realism" of burnable artificial logs. Little has been done in order to provide a product that produces realistic sounds and scents for a vented-gas fireplace.

Therefore, there is the need for a composition that produces the realistic sounds and scents of a vented-gas fireplace.

The foregoing reflects the state of the art of which the inventors are aware, and is tendered with a view toward discharging the inventors' acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The instant invention combines a crackling additive such as seeds, with ceramic spheres and liquid ingredients, to produce a pourable composition capable of being placed in a vented-gas fire place and further capable, when heated to an effective temperature, of producing realistic sounds and scents of a natural wood fire. The composition has to be heated, but not burned in order to perform. Approximately one tablespoon of the composition produces popping sounds of a duration ranging between 30–120 minutes, depending on the heat generated from the vented-gas fireplace. For optimal performance, the composition should be placed in a ceramic receptacle that allows the composition to be piled to a height of between ½" and 1". When combined with scented oils, and heated, the composition produces scents similar to those of a natural burning fire.

The following objects and advantages will be revealed from the detailed disclosure of the invention:

It is an object of the invention to provide a composition for use in a vented-gas fireplace that produces the realistic sounds and scents of a wood fire.

It is a further object of the invention to provide a pourable composition that can be scooped from a container in tablespoon quantities, and used as needed.

Further objects and advantages of the invention will be brought out in the following portions of the specification, wherein the detailed description is for the purpose of fully disclosing preferred embodiments of the invention, without placing limitations thereon.

DESCRIPTION OF THE PREFERRED EMBODIMENTS

The inventive composition combines a crackling additive, a hollowing agent, an insulating agent, and a liquid component, which results in a pourable composition that creates the realistic sounds and scent of a traditional wood fire. The composition is intended for use in a gas-vented fireplace and preferably poured or spooned into a ceramic receptacle and heated. The composition need only be heated, and not burned, to produce all of the mentioned effects of a traditional wood fire.

It has been found that a composition consisting of up to sixteen (16) solid materials and various liquid materials produces an overall composition that, when heated, produce realistic popping and crackling sounds for a sustained period of time. Such an exemplary composition with percentage breakdowns of components is depicted in Table 1.

TABLE 1

| Solid Ingredients | Amount in Ounces | % of Mixture |
|---|---|---|
| Green Coffee Beans | 1.500 | 17% |
| Coriander | 0.250 | 3% |
| Sesame Seeds | 0.250 | 3% |
| Mustard Seed | 0.500 | 6% |
| Poppy Seed | 0.250 | 3% |
| Oats | 0.750 | 9% |
| Cardamon Seed | 0.250 | 3% |
| Caraway | 0.125 | 1% |
| Cumin | 0.125 | 1% |
| Buckwheat | 0.250 | 3% |
| Flax | 0.500 | 6% |
| Calcareous Sand | 1.500 | 17% |
| Pumice | 0.750 | 9% |
| Volcanic Ash | 1.000 | 11% |
| Z-light Spheres G-3500 | 0.500 | 6% |

TABLE 1-continued

| | | |
|---|---|---|
| Rock Salt | 0.250 | 3% |
| Sub Total | 8.750 | 100% |
| Liquid Ingredients | Amount in fl. oz | |
| Saturated/Polyunsaturated/ Mono-unsaturated/Saturated/ Polyunsaturated | 0.425 | 56% |
| Scented Oil | 0.170 | 22% |
| Water | 0.170 | 22% |
| Sub Total | 0.765 | 100% |

The seeds and other edible items (green coffee beans, coriander, sesame, mustard, poppy, oats, cardamom, caraway, cumin, buckwheat, flax, and rock salt) all produce a crackling sound when heated to a given temperature. Of all the items in the edible crackling component, the inventive composition includes coffee beans in the highest percentage. The pumice, volcanic ash and calcareous sand act as insulating agents. The Z-light Spheres G-3500 are hollow and therefore act as a hollowing agent by imparting spaces within the composition that are not occupied by the edible items and insulating agents. The insulating and hollowing agents slow the rate at which heated air reaches the edible items, thereby preventing the composition from popping too quickly. While the hollowing agent can be left out of the composition, its presence creates a significantly lengthened popping time over when the hollowing agent is deleted from the composition. The spheres, pumice, volcanic ash and calcareous sand do not pop. The liquid oil components can be any saturated, polyunsaturated or mono-unsaturated oil. Olive oil, or soybean and canola oil blends are exemplary. The water and the oil components facilitate the adhesion of the spheres, pumice, volcanic ash, and calcareous sand to the seeds and other edible items. The scented oils, such as campfire smoke, provide a realistic aroma of a natural wood-burning fire.

It has been found that a tablespoon of the composition provides a realistic wood fire experience for between 30–120 minutes.

Accordingly, the inventive composition described herein offers a more realistic fire experience to gas fireplace users.

Finally, although the description above contains many specificities, these should not be construed as limiting the scope of the invention but as merely providing illustrations of some of the presently preferred embodiments of this invention. This invention may be altered and rearranged in numerous ways by one skilled in the art without departing from the scope of the invention.

We claim:

1. A pourable composition for creating a realistic crackling sound in a gas fireplace, comprising: a hollowing agent, a liquid component, and a crackling additive present in an effective crackling amount to provide an audible crackling sound during the heating of the composition.

2. A pourable composition for creating a realistic crackling sound in a gas fireplace, comprising: a hollowing agent a liquid component and a crackling additive present in an effective crackling amount to provide an audible crackling sound during the heating of the composition wherein the crackling additive is selected from the group consisting of: 1) a seed, including green coffee beans, coriander seeds, sesame seeds, mustard seeds, poppy seeds, oats, cardamon seeds, caraway seeds, cumin, buckwheat, flax and rock salt.

3. The pourable composition of claim 2, wherein the hollowing agent is selected from the group consisting of hollow synthetic spheres.

4. The pourable composition of claim 2, further comprising an insulating agent.

5. The pourable composition of claim 4, wherein the insulating agent is selected from the group consisting of pumice, volcanic ash, and calcareous sand.

6. The pourable composition of claim 2, wherein the liquid component is selected from the group consisting of oil, water, and compositions of oil and water.

7. The pourable composition of claim 6, wherein the oil is olive oil.

8. The pourable composition of claim 6, wherein the oil is a soybean and canola oil blend.

9. The pourable composition of claim 2, further comprising a scented oil component.

10. The pourable composition of claim 9, wherein the scented oil component is that of campfire smoke.

11. The pourable composition of claim 2 wherein heating the composition to a sufficient temperature produces audible crackling sounds for a duration of between 30–120 minutes.

12. The pourable composition of claim 11, wherein a tablespoon amount of the composition will produce audible crackling sounds for a duration of between 30–120 minutes.

13. The pourable composition of claim 2, wherein the green coffee beans comprise the largest percentage component of the crackling additive.

14. A pourable composition for creating a realistic crackling sound in a gas fireplace, comprising: an insulating agent, a liquid component, and a crackling additive present in an effective crackling amount to provide an audible crackling sound during the heating of the composition.

15. The pourable composition of claim 14, further comprising a hollowing agent.

16. The pourable composition of claim 15, wherein the hollowing agent is hollow glass spheres.

* * * * *